United States Patent [19]

Winker et al.

[11] 3,939,919

[45] Feb. 24, 1976

[54] BULLDOZER FRAME WITH ARM STRESS EQUALIZER

[75] Inventors: Bernard L. Winker, Chicago; John W. Gaines, Wheaton, both of Ill.

[73] Assignee: International Harvester Company, Chicago, Ill.

[22] Filed: Dec. 5, 1974

[21] Appl. No.: 529,782

[52] U.S. Cl. ..... 172/803

[51] Int. Cl.[2] ..... E02F 3/76

[58] Field of Search ..... 172/803, 804, 805, 807, 172/809, 801, 802, 806, 808

[56] References Cited

UNITED STATES PATENTS

| | | | |
|---|---|---|---|
| 3,234,670 | 2/1966 | Fryer et al. | 172/803 |
| 3,743,032 | 7/1973 | Schick | 172/803 |
| 3,820,610 | 6/1974 | Fryrear et al. | 172/803 |

*Primary Examiner*—Richard C. Pinkham
*Assistant Examiner*—Richard T. Stouffer
*Attorney, Agent, or Firm*—John W. Gaines; Floyd B. Harman

[57] ABSTRACT

Arm stress equalizer in tiltable, diagonal strut braced, bulldozer blade mountings, comprising an intervening link having closely adjacent portions of the link proper universally connected to the inner end of different ones of the diagonal struts, and having a prolongation to the link proper rendering the latter swingable toward and from the bulldozer blade. The prolongation is disposed in the central longitudinal plane of the bulldozer, is at the lower end of the link proper, and provides an offset therein which extends diagonally downwardly and forwardly from the struts and the one end of the link proper. The geometry selected insures equalization of side-load-imposed stress in the so-called pusharms provided for mounting the blade, and further insures limitation of stress in the pusharms when, under the special circumstance of an imposed side load condition and a tilted blade condition, the tilt induced stress then tends to be additively superimposed in one of the already side-stressed pusharms.

10 Claims, 6 Drawing Figures

FIG. 4.
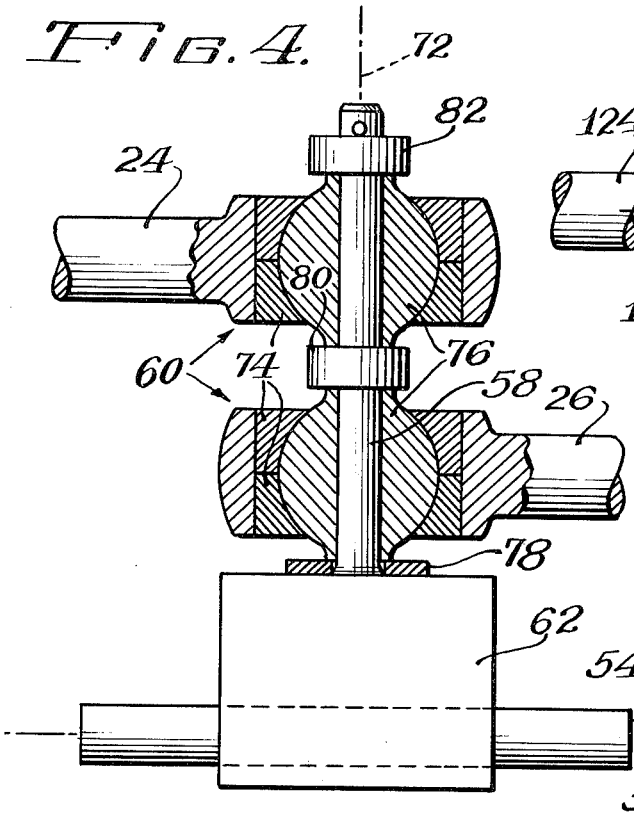
FIG. 5.
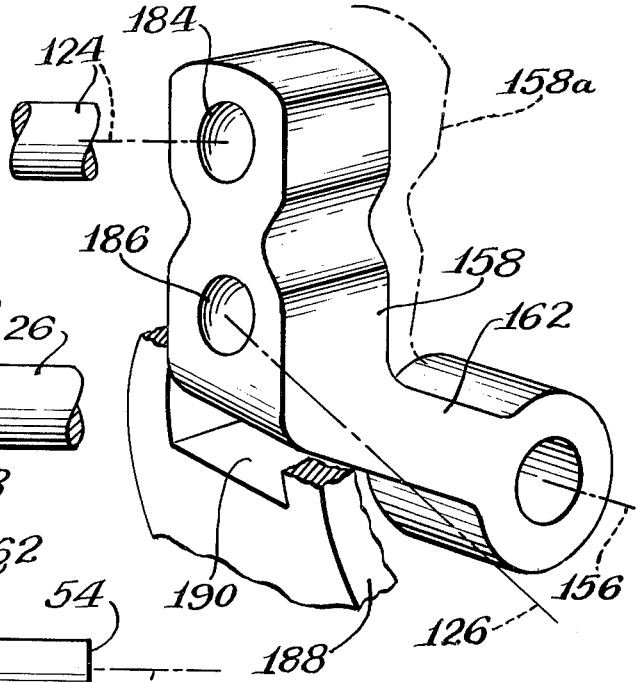
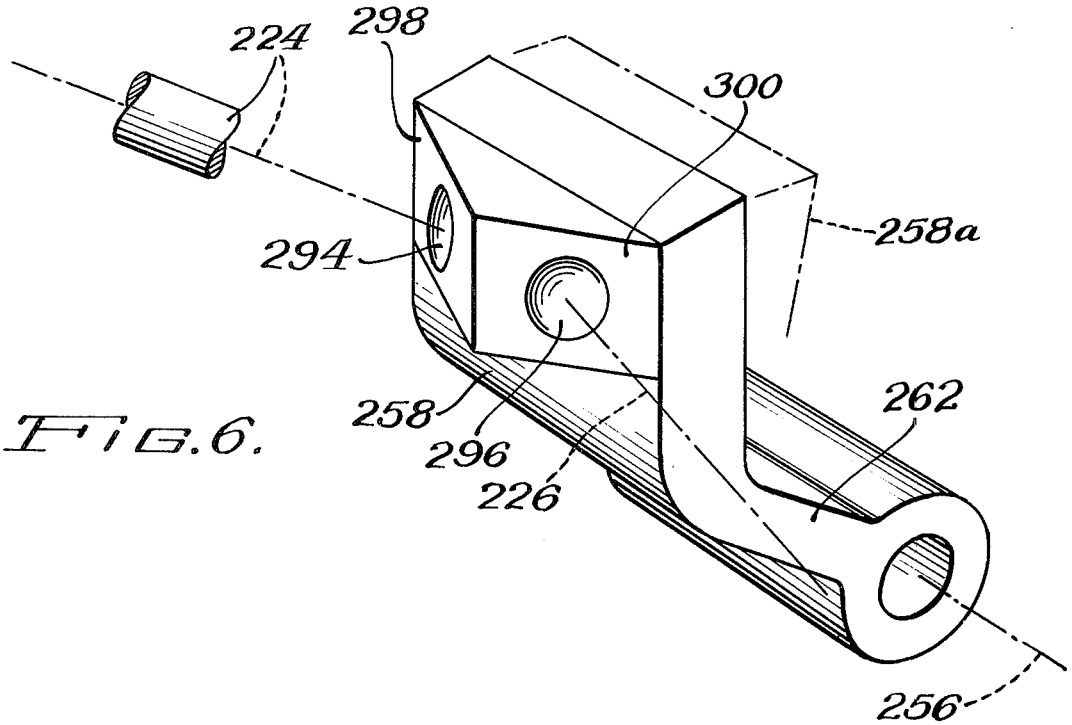
FIG. 6.

BULLDOZER FRAME WITH ARM STRESS EQUALIZER

This application appertains to a tiltable bulldozer blade and a mounting thereof. Generally, it relates to means for so mounting the blade on a bulldozer as to prevent damage from overstresses that might otherwise be expected to be set up in the mounting when the blade is side loaded in its tilt and untilted positions. The application particularly relates to a diagonal strut at each side or corner of the mounting, and the means of connection of each strut to the blade and a pusharm at that side, such means of connection being characterized by a bottom-hinged equalizer link.

There are three principal axes, all horizontal, for a dozer blade has in connection with its motions of adjustment. That is, the blade's lift axis is transverse to the line of bulldozer travel and passes through the rear or secured ends of the two pusharms. The blade's tilt axis is in the central longitudinal plane of the bulldozer. The blade's pitch axis, which passes through the front ends of the pusharms, is the significant axis here because the axis of the referred to bottom-hinge is at least in closely adjacent parallelism to the pitch axis and, preferably herein, is coaxial therewith.

While it should not necessarily have been the case in the past that changes in the pitch or suction angle of a dozer blade about its pitch axis disturb the equalizer linkage carried by such blade, or the case in the past that changes in angle of the equalizer link to relieve tilt stresses must disturb the suction angle at which the blade is set, such cases are common in prior art equalizer frames.

And, from the geometry standpoint, it is also common in prior art equalizer frames to employ, on the rear of the dozer blade thereof, a depending link either serving as the equalizer link itself or serving to support equalizer linkage at the rear of the blade.

The present invention employs an improved geometry design, materially alleviating if not substantially eliminating the situations of the foregoing cases and, in the intended way, our bottom-hinged design divorces the equalizer movement so that blade pitching transpires altogether independently thereof. Specifically, in carrying out our bottom-hinged link design for dozer blades, we provide a link supporting, single swing connection on the center rear of the blade in substantial coaxial alignment with, and in the direction of, the referred to transverse, horizontal, blade pitch axis; and we further provide, between the blade and inner ends of the diagonal struts, a generally upstanding one piece, connecting link proper, arranged with closely adjacent portions of the connecting link proper universally connected to different ones of the diagonal struts at their inner end, and arranged with a downward prolongation to the upstanding link proper connected to the single swing connection for the common link.

Various features, objects, and advantages will either be specifically pointed out or become apparent when, for a better understanding of our invention, reference is made to the following description, taken in conjunction with the accompanying drawings which show certain preferred embodiments thereof and in which:

FIG. 4 is a rear elevational view taken along the section line IV—IV of FIG. 3;

FIG. 5 is a view similar to FIG. 2, but it shows a modification; and

FIG. 6 is similar, but shows a further modification.

In a dozer tiltable blade mounting having a compensating brace connection to the blade so as to embody the improved noninterfering geometry according to our invention, a frame 10 moves up and down with an upright dozer blade 12 mounted thereon to raise and lower the latter. The blade 12 is independently moveable on the frame in the direction of the single tailed arrow in FIG. 1 into different pitched positions such as indicated by the broken lines 12*a* to change the suction angle, and is moveable by the frame in the direction of the double tailed arrow in FIG. 1 to different tilted positions such as indicated by the broken lines 12*b*.

The geometry of blade tilt will serve as background interest to the reader at this point. In known bulldozer frames, tilting the blade induces bending forces in the pusharms, both of which tend to bow outwardly under the strain. This tendency is explained in U.S. Pat. No. 3,452,828 and No. 3,654,558, which are owned by the same assignee and the disclosure of which relative to the mechanics of pusharm bending is incorporated in entirety herein by reference. Various purposes are served by tilting the blade, such as accomplished by lowering the blade at one corner in order to get that corner under an obstructing boulder, and perforce to loosen and work the boulder out of the ground.

Figure 1:
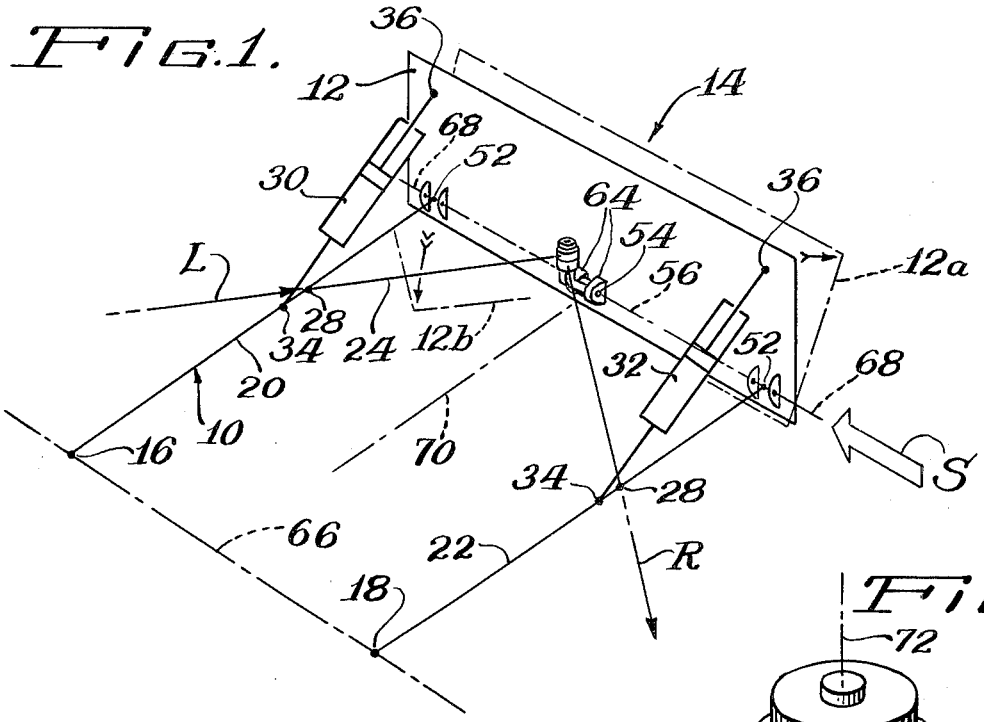
FIG. 1 is an isometric, three quarters showing of a crawler bulldozer embodying the invention, as viewed from the right rear and with only the front portion thereof appearing.
Figure 3:
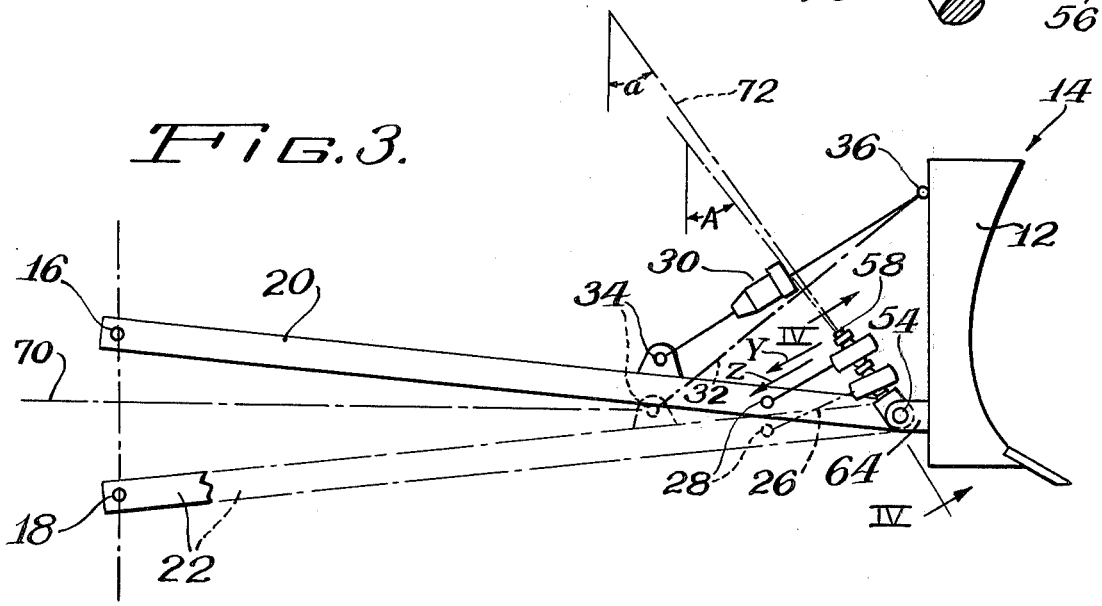
FIG. 3 is a showing in side elevation of the bulldozer of FIG. 1, as viewed from the right side and with the link detail greatly exaggerated for illustrative purposes.

More particularly, in FIGS. 1 and 3, a crawler dozer 14 constituting an outside arm bulldozer includes a tractor which carries left and right trunnions 16 and 18 on the outside of, and generally adjacent the rear portions of, the tractor's left and right crawler tracks, not shown.

The trunnions 16, 18 form ball type universal joints with the rear ends of longitudinally extending laterally spaced apart, left and right pusharms 20 and 22 included in the frame 10. The frame further includes left and right diagonal braces or struts 24 and 26 universally connected by ball joints 28 to an intermediate, inner side portion of the corresponding left and right pusharms 20 and 22.

The frame 10 further includes left and right tilt cylinders 30 and 32 connected by pivot pins and brackets 34 to the top of the pusharms and connected by ball joints 36 to the back of the blade 12 adjacent its upper edge.

Means is provided for raising and lowering the dozer frame 10, and includes an appropriate lift frame, not shown, carried on the front of the bulldozer 14. Although hoist cables are equally adapted to raise and lower the frame and blade 12, it is preferably hydraulic lift cylinders and appropriate gimbaling which are provided. Blade lift control and gimbaling are explained in Pat. No. 3,422,729, which is owned by the same assignee and the disclosure of which lift controls and the gimbaling is incorporated in entirety herein by reference.

A universal action joint between each of the pusharms and the blade 12 is provided by crossed pins in each joint consisting of a horizontal pin parallel to the length of the athwartwise extending blade 12 and a vertical pin or, as illustrated, by a ball joint 52 for each pusharm. Generally adjacent the corners of the frame 10 so formed, the diagonal struts 24 and 26 extend from the ball joints 28 inwardly and forwardly from the inner sides of the push arms, and means of securement to the blade is provided at the inner ends of the struts, described as follows.

SECUREMENT — FIGS. 1, 2, AND 3

Figure 2:
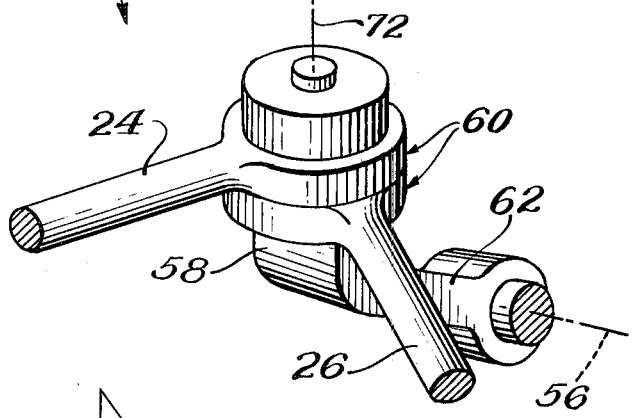
FIG. 2 is a similar showing, of a link detail of FIG. 1 but to larger scale.

For purposes for securing the struts, a link-supporting, horizontal pivot pin type of single swing connection 54 defining a horizontal axis 56 is secured to the bottom central rear portion of the blade 12 at a distance below the generally common level of the inner ends of the diagonal struts 24 and 26. The struts have a one piece, common connecting link proper 58 (FIG. 2). The common link is arranged with separated portions of the connecting link proper 58 having ball joints 60 forming universal connections to different ones of the diagonal struts at their inner end, and further arranged with an obtusely diagonal integral prolongation 62 at one end of the connecting link proper connected to the single swing connection 54 for the common link. Horizontally spaced apart lugs 64 (FIG. 1) support the swing connection 54 on the blade 12 in a manner to rearwardly offset the axis 56 thereof and also to fix the level of the axis relative thereto.

HEIGHT — FIG. 1

Conjoint extension and conjoint foreshortening of the lift cylinders, not shown, change the elevation of the bulldozer frame 10 and the blade 12 thereon by pivoting the former up and down about the arthwartwise horizontal axis indicated at 66 and interconnecting the left and right trunnions 16 and 18 of the crawler bulldozer 14.

PITCH — FIG. 1

Conjoint foreshortening and conjoint extension of the tilt cylinders 30 and 32 pitch the blade 12 between its solid line upright position and a position indicated by broken lines 12*a*, the latter position being frontwardly pitched and providing an increased suction angle for ease in handling hard material, for example. To that end, the ball joints 52 between the blade and the pusharms 20 and 22 at their forward end define an athwartwise blade pitch axis 68.

The horizontal swing connection axis 56 has either coaxiality with or closely spaced parallelism to the blade pitch axis 68. The upstanding position of the bottom hinged link is not changed during blade pitching, for the reason that the pin type single swing connection 54 divorces the link's movement from blade pitching movement because of the near or preferably actual coincidence of the swing axis 56 with the pitch axis 68.

TILT — FIGS. 1 AND 3

When a first on the tilt cylinders remains at constant length while the other (e.g. cylinder 30) acts, as by foreshortening, or when the first named cylinder acts in the opposite direction, as by extending while the other (e.g., 30) is foreshortening, the blade 12 pivots generally about a longitudinal central axis 70. The result of the pivoting, called tilt, is that one end of the blade, e.g., the left end as shown in FIG. 1, goes down while the right end goes up, with the blade taking the position indicated by the broken lines 12*b* in conformity with the tilt angle selected. The equivalency of the tilting motion as indicated by the double tailed arrow in FIG. 1 is as if the pusharms 20 and 22 at their rear were to have been inwardly deflected, by increments forcing the inner ends of the diagonal struts 24 and 26 forwardly. About the bottom hinge of its swing connection 54, the link proper 58 moves generally toward the blade 12 and causes the acute vertical angle of its generally upright axis 72 (FIG. 2) to untilt slightly. Of course, the blade tilts either way from horizontal position, and the link must compensate accordingly.

Under such blade tilting, the link pivots only forwardly, and never angles rearwardly from its home position. Inasmuch as there is no solid metal path against which the inner or forward ends of the diagonal struts can react, the "give" in the mechanism relieves practically all of the pure-tilt-caused stress, and bending forces are not set up on the inner side of the pusharms 20 and 22 at the ball joint connections 28.

The tilt position just described is illustrated in FIG. 3, wherein the acute vertical angle A of the link upright axis has reduced to the slightly smaller acute vertical angel *a* of the axis 72 of the link proper 58 as shown in solid lines. When the blade 12 is untilted, the link proper 58 and the inner ends of the diagonal struts return from their position of advancement so that the link axis resumes its initial acute vertical angle A.

Obviously, stress relief accommodated through movement of the upstanding end of the connecting link proper 58 in guiding the ends of the diagonal struts is a necessity or else the basic purpose would not be served. In conjunction therewith, novelty is felt to reside in achieving one important design objective hereof, namely, divorce of the blade 12 so that it can maintain the same suction angle during tilting, by virtue of the bottom swing connection 54 enabling the link proper 58 to tilt to and fro relative to the unpivoting blade without necessarily disturbing the suction angle.

Importance resides in two more design objectives hereof in connection with our bottom hinged link. The two are: first nonparallelogram action with, and second equalized stress between, the pusharms as will be later detailed.

PURE SIDE LOADING — FIG. 1

This condition results from a thrust on the blade 12 from either side, for instance, the one represented by the thrust vector S on the right side, resulting in a stress represented by the vector L in the pusharm 20 in reacting to diagonal compression in the strut 24, and a stress represented by the vector R in the pusharm 22 in reacting to diagonal tension in the strut 26. The geometry can readily be shown proving that the vectors L and R are equal loading vectors on the pusharms and prevent give or parallelograming of the frame; hence, the pusharms 20 and 22 equally strain in bending to actively resist the pure side load represented by the vector S.

That is to say, the pusharms geometrically share the pure side load represented by the vector S so that neigher pusharm is strained in excess of the other.

The methematics is equally readily developable to show load equalization between the pusharms 20 and 22 when the thrust represented by the vector S is applied to the blade 12 at the opposite side from the side of application illustrated in FIG. 1.

COMBINED TILT AND SIDE STRESS — FIG. 3

FIG. 3 can aid in visualizing the vectorial arrangement but not the structural arrangement of prior art frames lacking the present stress equalization and/or limitation. A side load in the direction of the vector S previously described (FIG. 1) in a prior art frame vector diagram will cause compressive stress in the diagonal strut 24. The pusharm 20 reacts by outward bowing to the stut compressive stress, which stress is represented by a vector Y. The vector Y is superimposed additively in the strut to the stress of tilt therein represented by the existing vector Z, the combination of the two of which vectors causing reaction by the pusharm 20 through its ball joint 28 so as to overstress the prior art pusharm in bending.

By way of comparison, however, tilt stress on which side load stress is superimposed does not additively combine as such a bending force in our pusharm 20 when tilted due to the blade tilt illustrated in FIG. 3. All or most of the tilt stress which would generate as compression, as represented by the vector Z in the prior art frame being considered, dissipates in thin air as our link proper 58 freely swings to the forwardly tilted advanced position shown by solid lines in FIG. 3.

One of our design objectives of bottom hinging proves itself out in the basic simplicity of providing the single offset swing connection 54 for the compensating link. The link is single link, amounting essentially to one additional part which, when added to an unrelieved prior art frame, converts same to a stress relieved or stress limited frame.

SOCKETED STRUTS — FIG. 4

The ball joints 60 are one of the types of universal connection preferred for the diagonal struts which, in that connection at their inner end, are each formed with an eye receiving socket halves 74 of the respective ball joints. The two balls 76 themselves are received in closely vertically spaced apart relation on the link proper 58 to keep the ball joints 60 fixed vertically adjacent one another. The lower ball 76 as viewed in FIG. 4 has an intervening spacer 78 therebelow resting against the prolongation 62 of the bottom hinged link, and has another spacer 80 thereabove resting against the upper ball 76. A retainer collar shown at 82 holds the ball joints on the link proper 58 and means, not shown, retain the socket halves 74 firmly inside the eyes of the struts 24 and 26 at their inner end.

Other than for the essentiality of universal connections such as ball type joints carried at each end, or at least at the inner end, the diagonal struts 24 and 26 are of standard bipartite construction, adjustable to a fixed length by the usual screw threaded connection provided between the end parts of the strut.

The struts are used for alignment purposes during initial installation of the frame, made while the lengthwise mounted blade 12 is horizontal. The struts 24 and 26 are foreshortened to draw the link proper away from the blade until there is sufficient clearance for compensating movement by the link.

SOCKETED LINK PROPER — FIG. 5

The vertically adjacent ball joint connections can be provided in accordance with our invention by having the sockets 184 aand 186 for the respective struts 124 and 126 formed vertically closely spaced apart on the link proper 158 so that the resulting ball joints are vertically adjacent. In the arrangement illustrated in FIG. 5, the struts such as the strut 124 will each be formed with an obtuse bend at the inner end enabling a ball, not shown, carried thereby to freely enter into, work within, and be retained inside the socket 184.

For relief of some of the hinging load arising from lateral forces, each of our upstanding links can be provided with a generally semi-circular bracket 188 secured at the top and the bottom to the back of the blade, not shown. Preferably the curve of the bracket 188 has its axis coaxial with the hinge axis 156.

The link works within a concentric arcuate guide slot 190 in the bracket as the link proper moves between its displaced forward position as shown by the broken lines 158*a* and its normal equilibrium or home position as shown by the solid lines 158.

HORIZONTALLY ADJACENT LINK SOCKETS — FIG. 6

In this modification, the link sockets 294 and 296 for balls on the respective diagonal struts 224 and 226 are formed in faces 298 and 300 which are at an obtuse angle to one another and formed at the upper end of the link proper 258. Proximity between the sockets renders the resulting ball joints horizontally adjacent one another as they move with the link proper about the hinge axis 256, while the link pivots between its home position as shown by solid lines and the advanced position shown by the broken lines 258*a* in FIG. 6.

The ball retainer plates, not shown, which fit upon the faces 298 and 300 after the balls are socketed are secured to those faces by the usual expedient such as screws and tapped bores in the link proper 258.

Achieved in the desired manner with the foregoing, is the two way divorce as between pivoting of the equalizer link independently of the blade pivoting, and pivoting of the blade independently of the link pivoting.

Variations within the spirit and scope of the invention described are equally comprehended by the foregoing description.

What is claimed is:

1. In a dozer blade frame including a pair of longitudinally extending and laterally spaced apart pusharms pivotally connected at the front end to the rear of the blade so as to define a generally horizontal blade pitch axis, a pair of diagonal struts connected to and extending forwardly from the pusharms inner sides toward one another with their inner ends terminating in mutual adjacency and adjacent the central rear of said blade, an interconnecting link disposed generally at an acute vertical angle for attachment between the diagonal struts and blade, and a pair of adjustable braces extending upwardly between the pusharm tops and the blade, each adjustable brace hydraulically responsive to be set simultaneously in the same motion of adjustment or in the opposite motion or at rest, when the other is set in motion of adjustment, respectively, to change the pitch angle or to change the tilt angle of the blade, the improvement effecting an equalization/limiting function in pusharm stressing characterized by having:

first, said link pivotally connected at a generally upstanding free end thereof to said inner ends of the diagonal struts whereby to move therewith to and fro relative to the blade without attendant disturbance necessarily of the pitch angle of the latter; and second, said link pivotally connected at a secured lower end thereof to the central rear of said blade on a horizontal pivot axis essentially concentric with said blade pitch axis whereby the blade pitches to and fro relative to the link without disturbing the acute vertical angle of the latter.

2. The invention of claim 1, characterized by the link-connected diagonal struts having mutually horizontally adjacent inner ends.

3. The invention of claim 1, characterized by the link-connected diagonal struts having mutually vertically adjacent inner ends.

4. The invention of claim 1, the end connections of the respective diagonal struts to the link comprising ball-and-socket joints.

5. The invention of claim 4, the ball-and-socket joints characterized by the sockets thereof carried by mutually vertically adjacent inner ends of the diagonal struts.

6. The invention of claim 4, the ball-and-socket joints characterized by the balls thereof carried by the inner ends of the diagonal struts.

7. The invention of claim 6, characterized by vertically adjacent balls which are carried as described by the strut inner ends.

8. The invention of claim 6, characterized by horizontally adjacent balls carried as described by the strut inner ends.

9. In a dozer blade frame in which pusharms are provided, having mounting means of connection for mounting the blade thereon, having diagonal struts extending from the pusharm inner sides toward the blade, and having means to effect pitching of the blade on the blade mounting means about a horizontal pitch axis defined by the pusharm front ends, the improvement in stress equalization means for the pusharms, comprising:

a link supporting, single swing connection on approximately the center rear of the blade essentially in coaxial alignment with said generally horizontal pitch axis; and a generally upstanding one piece, common connecting link proper, arranged with closely adjacent portions of the connecting link proper pivotally connected to different ones of the diagonal struts at their inner end, and arranged with a downward prolongation to the upstanding link proper connected to the single swing connection for the common link.

10. The invention of claim 9, characterized by the closely adjacent link portions connected to the struts at their inner end being horizontally adjacent, said struts having longitudinal axes which intersect essentially adjacent the plane of the blade at a spaced apart height above said single swing connection.

* * * * *